US005569133A

United States Patent [19]

Vittone

[11] Patent Number: 5,569,133

[45] Date of Patent: Oct. 29, 1996

[54] SQUAT EXERCISE APPARATUS

[76] Inventor: Larry W. Vittone, Rt. 1, Box 55, Hurley, Wis. 54534

[21] Appl. No.: 350,534

[22] Filed: Dec. 7, 1994

[51] Int. Cl.[6] ..... A63B 21/06

[52] U.S. Cl. ..... 482/98; 482/135

[58] Field of Search ..... 482/94, 98, 101, 482/104, 106, 135, 148

[56] References Cited

U.S. PATENT DOCUMENTS

| | | | |
|---|---|---|---|
| 3,679,107 | 7/1972 | Perrine | 482/106 |
| 4,262,901 | 4/1981 | Faust | 482/104 |
| 4,586,536 | 1/1991 | Zane | 482/106 |
| 5,050,868 | 9/1991 | Pearson | 482/94 |

*Primary Examiner*—Richard J. Apley
*Assistant Examiner*—John Mulcahy
*Attorney, Agent, or Firm*—Michael E. McKee

[57] ABSTRACT

An exercise apparatus for use as a user performs knee-bending exercises while maintaining his balance over his feet includes a grip stably mounted adjacent the user and which is capable of being grasped and held with a hand of the user as the user bends his knees between bent and extended conditions. When held with the hand during the performance of a knee-bending exercise routine, the grip stabilizes the user and thereby enables the user to maintain his balance over his feet with relative ease. The grip of the apparatus is particularly well-suited for use during the performance of a squat exercise routine during which a weight-laden yoke is moved between elevated and lowered positions as the user repeatedly moves between standing and squat positions.

The weight-laden yoke includes a yoke portion positionable across the neck of the user. The yoke portion is pivotally attached to weight-laden carriages guided on vertical rods. In one embodiment, the grip is cooperatively attached to the weight-laden yoke so that when the weight-laden yoke is raised the grip is lowered and vice-versa.

4 Claims, 4 Drawing Sheets

SQUAT EXERCISE APPARATUS

BACKGROUND OF THE INVENTION

This invention relates generally to the field of exercise apparatus and relates, more particularly, to exercise apparatus for use during an exercise routine involving the movement of the user's knees between extended and bent positions while the user maintains his balance over his feet.

One of the most common exercise routines requiring an individual to move his knees between extended and bent conditions as he maintains his balance over his feet is the squat exercise wherein an individual raises and lowers his upper body between upper and lower positions as he moves between a standing position and a squat position. If the squat exercise is desired to be performed with weights, a bar having weights secured at each of its ends can be balanced and held across the neck of the individual as the individual moves between the standing position and the squat position.

Heretofore, squat exercises have been relatively difficult for some people to perform because of the balance required during the exercise routine. In other words, the difficultly which an individual may encounter while moving between a standing position and a squat position relates to the difficulty in maintaining one's balance over his feet during the exercise. Further, in the event that weights are supported across the shoulder's of an individual during a squat exercise, that individual's balance is more difficult to maintain. Such difficulties can be reduced when a spotter, i.e. an assistant, is employed to stand nearby and provide assistance during the exercise routine, but a spotter may not always be available. Consequently, due to either the aforedescribed difficulties which may be encountered in maintaining one's balance or the lack of availability of a spotter, squat exercises are often omitted from a workout. Of course, if squat exercises are omitted from a workout, the useful benefits which may result from squat exercises are omitted, as well.

It is therefore an object of the present invention to provide new and improved exercise apparatus for use during the performance of a squat exercise routine whose structure renders the performance of the exercise less difficult and reduces the need for a spotter during the routine.

Another object of the present invention is to provide such an apparatus which can be used for the performance of a squat exercise routine with or without the addition of weights to a user's body.

Still another object of the present invention is to provide such an apparatus which can be used by individuals whose strength may fall within a relatively broad range of strengths.

Yet another object of the present invention is to provide such an apparatus which is uncomplicated in construction and effective in operation.

SUMMARY OF THE INVENTION

This invention resides in an exercise apparatus for use as a user performs knee-bending exercises while maintaining his balance over his feet.

The apparatus includes means providing a grip which is attachable to a stable structure located adjacent the user and capable of being grasped and held by a hand of the user throughout the performance of a knee-bending exercise so that as the user performs the knee-bending exercise, the user stabilizes himself and is thereby able to maintain his balance over his feet with relative ease.

In a particular embodiment of the invention, the apparatus includes a base platform and at least one post mounted upon the platform so as to extend generally upwardly therefrom, and the grip is mounted upon the post.

The apparatus is particularly well-suited for performing squat exercises and, if desired, can be used in conjunction with a yoke assembly positionable upon the neck of a user and to which weights can be attached.

DETAILED DESCRIPTION OF AN ILLUSTRATIVE EMBODIMENT

Figure 1:
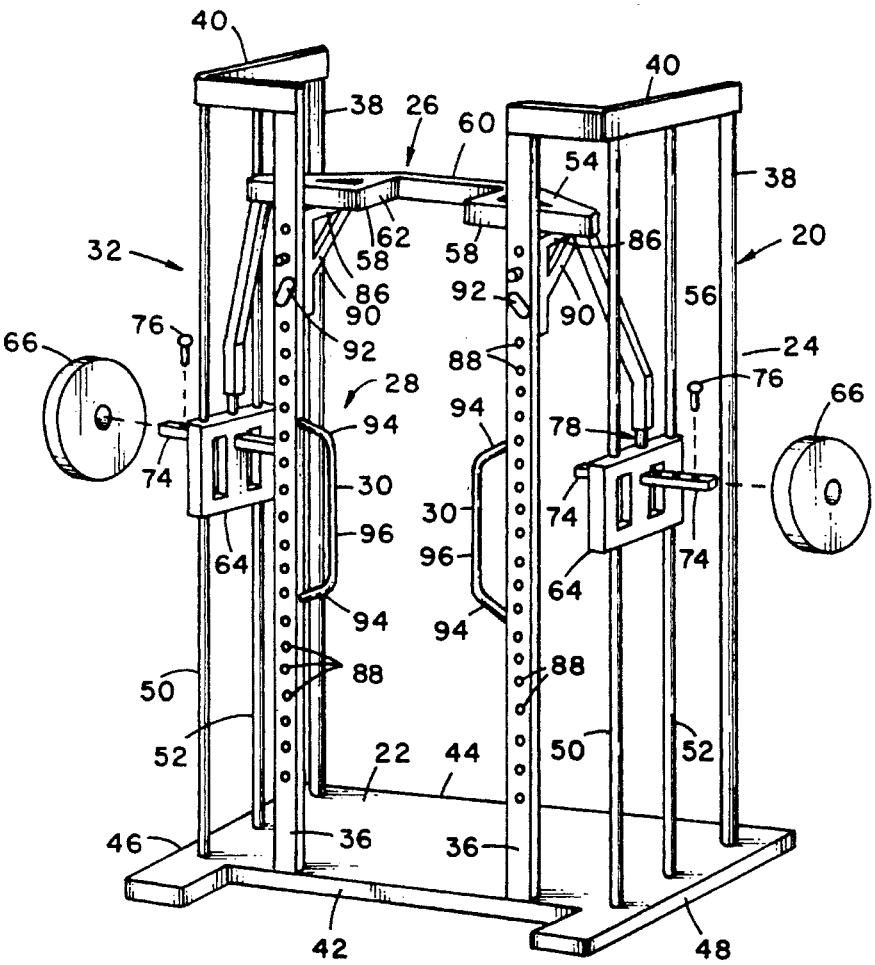
FIG. 1 is a perspective view of an embodiment of an apparatus within which the present invention is embodied.

Turning now to the drawings in greater detail, there is shown in FIG. 1 an exercise apparatus 20 within which features of the invention are embodied. The apparatus 20 includes a base platform 22 upon which a user may stand while performing exercises with the apparatus 20 and an upright support frame 24 mounted upon the platform 22. A weight-supporting yoke assembly 26 is provided within the apparatus 20 for positioning about the neck of a user, and grip means 28 are incorporated within the frame 24 enabling the user to easily stabilize himself and thereby maintain his balance over his feet during an exercise routine.

Figure 4:
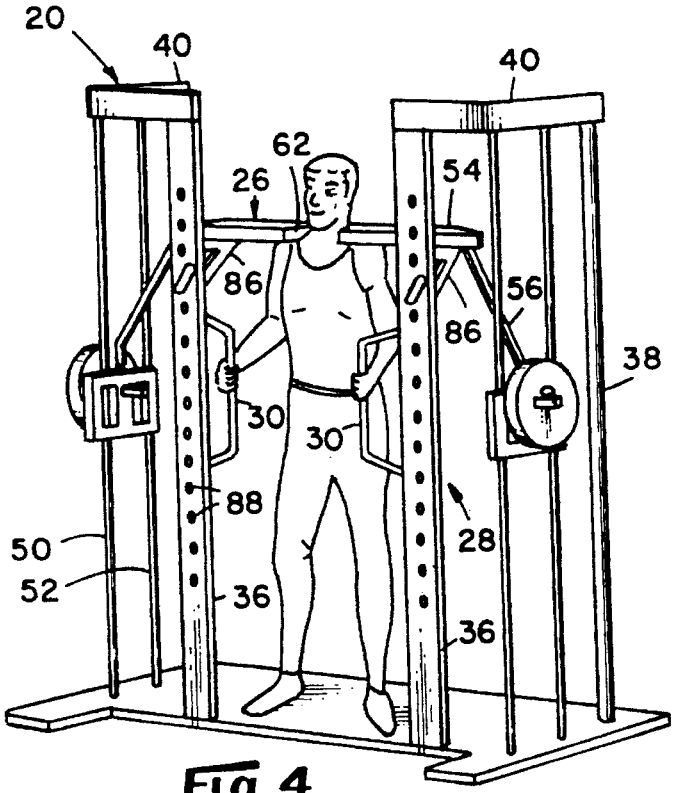
FIGS. 4 and 5 are perspective views of the FIG. 1 apparatus and a user of the apparatus when positioned in alternative positions during an exercise routine.
Figure 5:
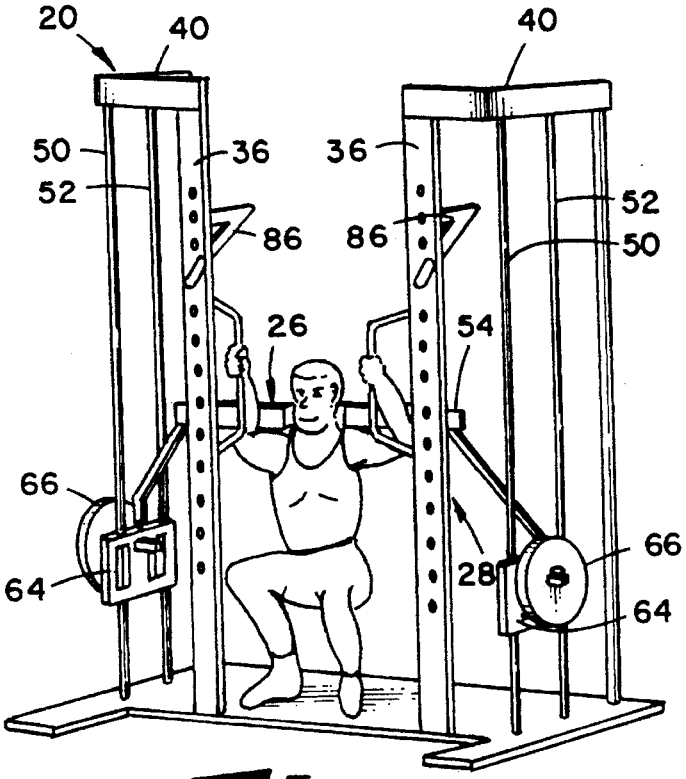

The depicted apparatus 20 is used to perform squat exercises as a user moves between a standing, upright position (as shown in FIG. 4) and a lower, squat position (as shown in FIG. 5) while the yoke assembly 26 rests upon the user's neck. The platform 22 is broad and flat in shape and includes a front edge 42, a back edge 44 and two opposite side edges 46, 48. In the depicted embodiment 20, the platform 22 is constructed of steel, but alternative materials, such as wood, may be employed.

The frame 24 of the apparatus 20 includes two sets of vertically-oriented posts 36, 38 and horizontally-oriented, elevated cross members 40 joining the posts 36, 38 together. Each post 36 in one set of posts is disposed adjacent the front edge 42 of the platform 22 while each post 38 in the other set of posts is located adjacent a corresponding side edge 46 or 48 of the platform 22.

It will be understood that as the user moves between a standing position and a squat position, the user's torso and shoulders, as well as the yoke assembly 26, moves upwardly and downwardly between elevated and lowered positions. It is a feature of the apparatus 20 that its frame 24 includes guide means 32 along which the yoke assembly 26 is guided as it is moved upwardly and downwardly as aforesaid. In this connection, the guide means 32 includes two sets of upstanding, parallel guide rods 50, 52 which are attached between so as to extend substantially vertically between the platform 22 and the Elevated cross members 40. Each set of rods 50 or 52 are disposed adjacent a corresponding side edge 46 or 48 of the platform 22. As will be apparent herein, the yoke assembly 26 cooperates with the sets of guide rods 50, 52 so that as the yoke assembly 26 is moved upwardly and downwardly during an exercise routine, the guide rods 50, 52 act as guideways to guide the yoke assembly 26 along vertical-oriented paths.

Figure 2:
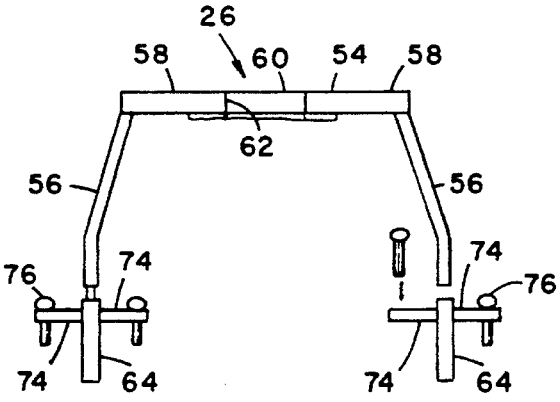
FIG. 2 is a front elevational view of the yoke assembly of the FIG. 1 apparatus.

With reference to FIG. 2, the yoke assembly 26 includes a horizontally-disposed, elongated portion 54 which extends across the platform 22 between the side edges 46, 48 thereof and angularly-disposed arm members 56 attached to so as to extend generally downwardly from the ends of the portion 54. The portion 54 is comprised of pieces of steel tubing of rectangular cross section which have been joined together to form a pair of triangle-shaped side portions 58 (as best shown in FIG. 1) joined by a back portion 60. A cutout 62 is formed between the side portions 58 to accept the neck of the user. Therefore, when the yoke assembly 26 is positioned upon the user, the user's neck is positioned within the cutout 62 and the side portions 58 rest upon the user's shoulders. Preferably, the underside of the side portions 58 and the back portion 60 are padded to render the yoke assembly 26 more comfortable when positioned across the user's neck.

Figure 3:
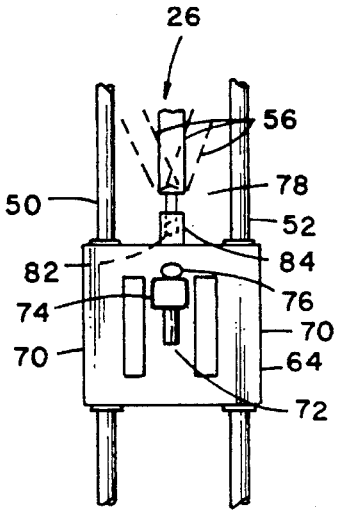
FIG. 3 is a side elevational view of a fragment of the FIG. 1 apparatus as viewed generally from the right in FIG. 1.

With reference to FIGS. 2 and 3, the yoke assembly 26 also includes a pair of carriage members 64 to which weights 66 FIG. 1) can be attached. Each carriage member 64 includes a somewhat rectangular-shaped frame section 68 and is attached to so as to depend downwardly from a corresponding arm member 56 of the yoke 26. The frame section 68 includes a pair of side portions 70 having vertically-oriented openings through which the guide rods 50 or 52 are slidably accepted and a mid-portion 72 joining the side portions 70. Shanks 74 are joined to the mid-portion 72 on each side thereof for accepting weights 66 directed over the free end thereof. Each shank 74 also includes a plurality of vertically-opening holes extending along the length thereof for accepting a pin 76 directed in a selected one of the holes. Upon Placing weights 66 upon a shank 74 and then placing the pin 76 within a hole provided along the shank 74, the weights 66 are prevented from coming off of the shank 74.

It follows from the foregoing that as the yoke assembly 26 is moved upwardly and downwardly during an exercise routine, each carriage member 64 is slidably moved upwardly and downwardly along its corresponding pair of guide rods 50, 52. Therefore, since the Guide rods are vertically-oriented, the movement of the carriage members 64 is confined along the vertical, i.e. along a vertical path. To accommodate a forward and rearward shifting of the horizontally-disposed portion 54 of the yoke 26 relative to the carriage members 64, each carriage member 64 is joined to a corresponding arm member 56 by means of a ball joint assembly 78. To this end, each arm member 56 includes a vertically-disposed portion to which a downwardly-depending ball 82 (FIG. 3) is attached. Each carriage member 64, in turn, includes an upwardly-directed tube 84 within which the ball 82 is captured in a manner which permits the ball 82 to rotate, to a degree, within the tube 84. Consequently, the horizontally-disposed portion 54 which is attached to the ball 82 by way of the arm member 56 is permitted to shift forwardly and rearwardly, i.e. fore and aft, relative to the carriage member 64 between the two positions illustrated in phantom in FIG. 3. As will be apparent herein, this fore and aft shift of the portion 54 accommodates the manual shifting of the portion 54 between a position of rest upon stop members 86, described hereinafter, and a position at which the portion 54 is substantially in vertical registry with the guide rods 50, 52 and also accommodates a fore and aft shift of the portion 54 as the user moves between standing and squat positions.

With reference again to FIG. 1, the stop members 86 of the apparatus 20, introduced above, are releasably attached to the posts 36 for supporting the yoke assembly 26 (and the weights 66 attached thereto) when the apparatus 20 is not in use. For attachment of the stop members 86 to the posts 26, each post 36 is provided with a series of circular openings 88 extending along the length thereof. The stop members 86 take the form of two brace members 90 wherein each member 90 includes an upper, horizontally-disposed piece and a pair of lugs adapted to be received by an adjacent pair of openings 88 in one of the posts 36. Preferably, one of the lugs of each brace member 90 is externally-threaded for accepting a cap 92 threaded thereupon to secure the brace member 90 in place upon the post 36. It follows that when each brace member 90 is secured to the posts 36 so as to be arranged at substantially the same horizontal level as the other brace member 90, the members 90 provide a rearwardly-directed shelf upon which the horizontally-disposed portion 54 of the yoke can be rested, and the series of openings 88 provided along the length of each post 36 accommodates the repositioning of the stop members 86 at alternative locations along the length of the post 36.

It is a feature of the apparatus 20 that its grip means 28 provides handles which the user holds with his hands during the performance of the squat exercise routine. In the depicted apparatus 20 and with reference again to FIG. 1, the grip means 28 includes a pair of handles 30 which are each attached to a corresponding post 36 disposed adjacent the front edge of the platform 22. Each handle 30 is somewhat U-shaped in appearance having a pair of relatively short legs 94 joined by a major linear grip section 96, and each handle 30 is fixedly joined, as by welding, to a side surface of a corresponding post 36 so that its major grip section 96 is arranged substantially vertically. As best shown in FIG. 1, the handles 30 are disposed adjacent the front of the apparatus 20 so that a user may easily reach and grasp the handles 30 while the yoke 26 is supported upon the user's shoulders. During an exercise, i.e. squat, routine, during which the user moves between a standing, upright position and a lower, squat position, the user maintains his grip about the handles 30. Accordingly, the handles 30 are positioned along the posts 36 at about the height which corresponds with that of the user's waist when the user is standing upon the platform 22. The handles 30, as well as the aforedescribed posts 36, 38, rods 50, 52, and yoke components 54 and 64 are constructed of suitable material, such as steel.

By way of example, the following handle-related dimensions have been found to render the handles 30 capable of being comfortably grasped by a user throughout a squat exercise routine. Each handle 30 is about 24.0 inches as measured between its legs 94 and is formed from steel tubing having an outer diameter which is about 0.75 inches. The lowermost leg 94 of each handle 30 is positioned about 26.0 inches above the platform 22, and the grip sections 96 of the handles 30 are spaced apart by a distance of about 30.0 inches.

To use the apparatus 20 and with reference to FIG. 4, the yoke 26 is initially placed across the stop members 86 at a height along the length of the posts 36 which is slightly lower than the user's shoulders and the carriage members 64 are laden with the desired amount of additional weights 66. The user then positions himself in such a relation to the yoke assembly 26 so that his neck is accepted by the cutout 62 provided in the horizontally-disposed portion 54 of the yoke, so that his shoulders are arranged beneath the side portions 58 of the yoke assembly 26 and so that he faces forwardly of the apparatus 20. The user then grasps the grip means 28 so that each of his hands holds the linear grip section 96 of a corresponding handle 30, and the user lifts the yoke assembly 26 from the stop members 86 with his shoulders and stands upright. With the neck positioned within the cutout 62 while the horizontally-disposed portion 54 is supported upon the stop members 86, the user's torso may be bent slightly forwardly at the waist and the horizontally-disposed portion 54 is disposed slightly forwardly of the guide rods 50, 52. Consequently, as the user lifts the yoke assembly 26 from the stop members 86 and stands upright to the intended position for a squat exercise, the horizontally-disposed portion 54 of the yoke shifts rearwardly to a position at which the horizontally-disposed portion 54 is in substantially vertical registry with the guide rods 50, 52 and so that during subsequent raising and lowering of the yoke assembly 26, the horizontally-disposed portion 54 clears the stop members 86.

The user then lowers the yoke assembly 26 as he permits his legs to bend at the knees and waist and as he maintains his grip upon the handles 30. The user may chose to lower himself to any of a number of alternative positions between the standing, upright position (as shown in FIG. 4) at which the knees are fully extended and the full squat position (as shown in FIG. 5) at which the knees are bent and the user's buttocks are relatively close to the platform 22. In any event, upon reaching the lower (squat) position of choice, the user returns to a standing, upright position with the yoke assembly 26 maintained upon the shoulders to complete a single cycle, or repetition, of the exercise. The lowering and raising of the yoke 26 is thereafter repeated, as desired, as the user's knees are moved between bent and fully-extended conditions and as the user's balance is maintained over his feet.

The grip means 28 of the apparatus 20 is advantageous in that it provides means by which the user can more easily stabilize himself and maintain his balance throughout an exercise routine. Such an advantage can be readily appreciated when comparing the use of the apparatus 20 to the performance of squat exercises with free weights, i.e. a weight-laden barbell, positioned across the user's shoulders. For example, during the performance of squats with a weight-laden barbell positioned across the shoulders, the user's hands are normally grasped about the barbell to stabilize the barbell. Meanwhile, the user must devote a great deal of concentration to the maintaining of his balance upon his feet as the user moves between upright and squat positions. In contrast, the apparatus 20, with its guide means 32, confines the movement of the yoke assembly 26 along a vertical path so that the yoke assembly 26 need not be grasped with the hands in order that the yoke assembly 26 is maintained upon the shoulders. Therefore, in the event that the apparatus 20 is used for a squat exercise routine, the user's hands are free to grasp the handles 30 for stability.

Furthermore, an individual who performs deep squats with a weight-laden barbell supported across his shoulders may find it difficult to return to a standing position from a deep squat position. Hence, the performance of deep squat exercises often require spotters for helping the individual return to a standing position, and such a need occasionally discourages and intimidates individuals to the point that squat routines are eliminated from a workout. However, a user of the apparatus 20, whose hands are grasped about the handles 30 rather than a shoulder-supported bar, may utilize his arms to raise, or pull, himself up from a deep squat position. Thus, the use of the apparatus 20 for the performance of deep squat exercises is not likely to require a spotter as do free weights which are positionable across the shoulders and is believed to be less intimidating or discouraging to a user for the performance of deep squat exercises than are free weights.

Figure 6:
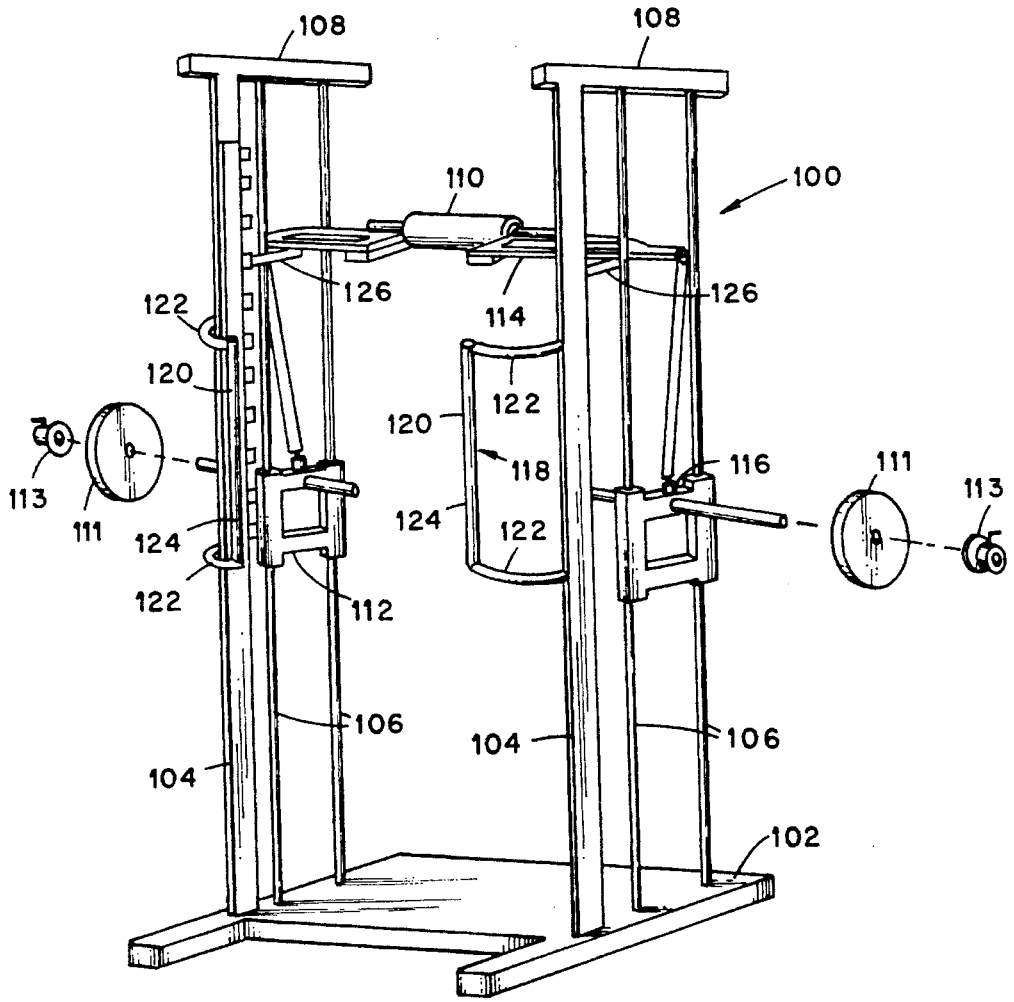
FIG. 6 is a perspective view of an alternative embodiment of an apparatus embodying the present invention.
Figure 7:
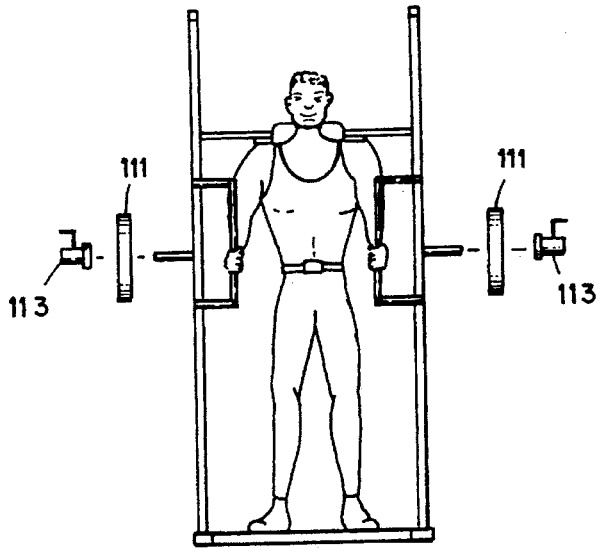
FIG. 7 is a front elevational view of the FIG. 6 apparatus and a user using the apparatus.

With reference to FIGS. 6 and 7, there is shown an alternative embodiment, generally indicated 100, of an apparatus within which features of the present invention are embodied. The apparatus 100 includes a base platform 102, upstanding sets of posts 104 and rods 106 mounted upon the platform 102 and secured at the top with a cross member 108, and a yoke 110 to which weights 111 can be secured by means of clamps 113. As is the case with the yoke 26 of the embodiment 20 of FIGS. 1–5, the yoke 110 of the embodiment 100 of FIGS. 6 and 7 cooperate with the upstanding rods 106 so that as the yoke 110 is raised and lowered during a squat exercise routine performed with the apparatus 100, the rods 106 serve as guide rods to confine the upward and downward movement of the yoke 110 along a substantially vertical path. To this end, there are provided two pairs of rods 106 wherein each rod pair is disposed adjacent corresponding side edge of the platform 102 and wherein the rods 106 in each pair are arranged in a parallel relationship. The yoke 110 includes a two carriage members 112 wherein each carriage member 112 accepts a corresponding pair of the rods 106 for sliding movement relative thereto and further include a horizontally-disposed portion 114 positionable about the shoulders of a user, as shown in FIG. 7. Each carriage member 112 is pivotally attached to a corresponding end of the portion 114 by way of a ball joint assembly 116 to accommodate a pivotal shift of the portion 114 relative to the carriage members 112 in forward and rearward directions relative to the platform 102. Stop members 126 are releasably secured to the posts 104 for supporting the yoke 110 when the apparatus 100 is not in use.

It is a feature of the apparatus 100 that it includes grip means 118 capable of being grasped by the user of the apparatus 100 during use of the apparatus 100. In the depicted apparatus 100, the grip means 118 includes a pair of handles 120 which are attached to the set of posts 104 depicted as positioned closest the front edge of the platform 102. Each handle 120 includes relatively short end portions 122 joined by a major linear mid-section 124. The end portions 122 of each handle 120 are affixed, as with welds, to a surface of a corresponding post 104 to secure the handles 120 to the posts so that the linear mid-section 124 is arranged substantially vertically. Each handle 120, as well as the yoke 110, posts 104, rods 106 and platform 102 are constructed of a suitable material, such as steel.

To use the apparatus 100 and with reference to FIG. 7, the desired amount of weight is secured to the yoke carriage members 112 and the user positions himself beneath the yoke 110 so that the weight thereof is centered upon his shoulders. With his hands grasped about the linear mid-sections 124 of the handles 120, the user then lifts the yoke 110 from the stop members 126 and positions the yoke 110 (while maintaining a standing position) so that upon subsequently lowering the yoke 110 during a squat exercise, the yoke 110 clears the stop members 126. While the user maintains his grasp upon the handles 120, the user lowers himself to a squat position by bending his knees. It follows that as the user squats and the yoke 110 is maintained upon the user's shoulders, the yoke 110 is also moved to a lower position as the movement of the carriage 112 is confined along a substantially vertical path. Once the user reaches the lower, squat position, he returns to an upright, standing position by straightening his knees. The raising and lowering of the yoke 110 is subsequently repeated as desired.

By maintaining his grip upon the handles 120 of the apparatus 100 during a performance of a squat exercise, the user stabilizes himself and can easily maintain his balance throughout an exercise routine. Furthermore, with the hands gripped about the handles 120, the user's hands and arms are in position to aid the return of the user to a standing position as the user pulls downwardly upon the handles 120. As is the case with the handles 30 of the apparatus 20 of FIGS. 1–5, the handles 120 of the FIG. 6 apparatus 100 are disposed generally forwardly of, albeit relatively close to, the user and arranged at about the same height as that of the user's waist.

Figure 8:
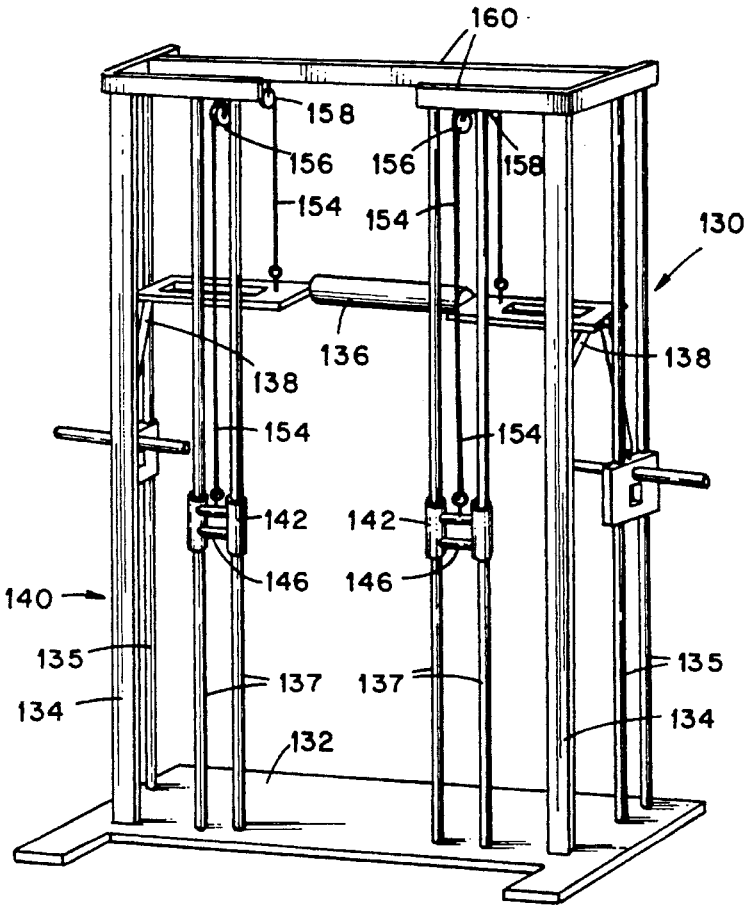
FIG. 8 is still another embodiment of an apparatus embodying the present invention.
Figure 9:
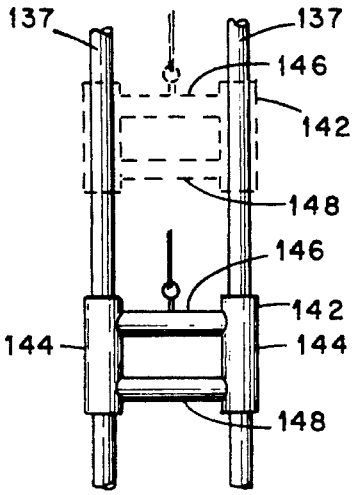
FIG. 9 is an elevational view of a fragment of the FIG. 8 embodiment as seen generally from the left in FIG. 8.

With reference to FIGS. 8 and 9, there is shown still another embodiment, generally indicated 130, of an apparatus in which features of the present invention are embodied. The apparatus 130 includes a base platform 132, sets of posts 134 and guide rods 135, 137 mounted upon so as to extend upwardly from the platform 132, a yoke 136 removably supported upon a set of stop members 138 attached to the posts 134, and grip means 140 associated with the rods 137. As are the yokes 26 and 110 of the embodiments 20 and 100 of FIGS. 1–7, the yoke 136 of the FIG. 8 embodiment 130 is adapted to rest upon the shoulders of a user as the user moves between standing and squat positions, but unlike the grip means 28 and 118 of the embodiments 20 and 100, the grip means 140 of the FIG. 8 embodiment 130 is adapted to slidably move upwardly and downwardly along the length of the guide rods 137 in conjunction with the movement of the yoke 136 between raised and lowered positions.

In this connection and with reference still to FIGS. 8 and 9, there exists two sets of guide rods 137 which are arranged in parallel and vertical relationship adjacent the front edge of the platform 132, and the grip means 140 includes a pair of grip-including carriages 142 slidably mounted upon the guide rods 137 of a corresponding set. Each carriage 142 includes a pair of tube portions 144 slidably arranged about a rod 137 and horizontally-disposed bars 146,148 joining the tube portions 144. The lower one, i.e. bar 148, of the two bars 146, 148 is adapted to be gripped by the user during the performance of an exercise routine, and there is fixedly attached to the upper bar 146 an eyelet 150. As will be apparent herein, each grip-including carriage 142 is permitted to freely slide upwardly and downwardly along the length of the rods 137 (between, for example, the solid-line and phantom-line positions illustrated in FIG. 9) as the rods 137 act as guideways along which the movement of the carriages 142 is confined.

The yoke 136 is joined to the grip means 140 by way of a pair of cables 154 which are each routed through a pair of pulleys 156, 158 attached to cross members 160 secured atop the posts 134 and rods 135, 137. More specifically, each end of one cable 154 is attached to a corresponding one of the yoke 136 and one of the carriages 142 (byway of the eyelet 150) and each end of the other cable 154 is attached to a corresponding one of the yoke 136 and the other of the carriages 142 so that downward movement of the yoke 136 effects an upward movement of the grip means 140, i.e. the grip-including carriages, along the rods 137 and so that downward movement of the grip means 140 effects an upward movement of the yoke 136 along the rods 137.

Figure 10:
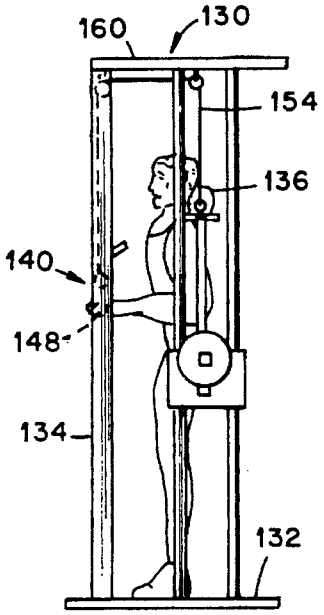
FIGS. 10 and 11 are side elevational views of the FIG. 8 apparatus and a user of the apparatus when positioned in alternative positions during an exercise routine.
Figure 11:
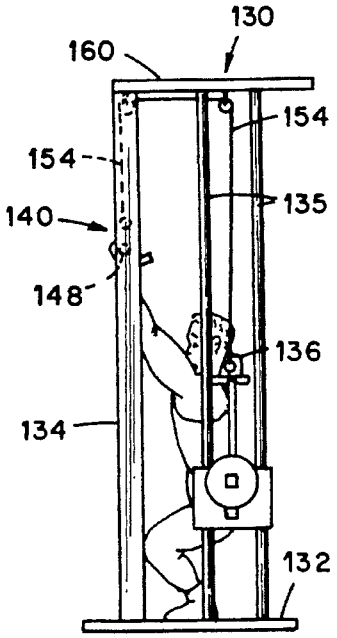

As the yoke 136 is supported across the neck of a user in preparation for a squat exercise routine and with reference to FIGS. 10 and 11, the user's hands are gripped about the horizontally-disposed grip bars 148 of the carriages 142. Then, during the performance of an exercise routine and while maintaining a grip about each grip bar 148 throughout the routine, the user bends at the knees from an upright, standing position, as shown in FIG. 10, to a squat position, as shown in FIG. 11, and then returns to the FIG. 10 standing position. As the yoke 136 is lowered from its FIG. 10 elevated position to the FIG. 11 lowered position, the grip means 140 is raised, by way of the cables 154, from the FIG. 10 lowered position to the FIG. 11 elevated position. Conversely, as the yoke 136 is raised from the FIG. 11 lowered position to the FIG. 10 elevated position, the grip means 140 is permitted to return from its FIG. 11 elevated position to the FIG. 10 lowered position.

In addition to the advantages provided by the aforedescribed grip means 28 and 118 of the embodiments 20 and 100 of FIGS. 1–7, the grip means 140 of the embodiment 130 of FIGS. 8–11 provides the additional advantage in that it better enables the user to use his arms to relieve at least a portion of the weight of the yoke 136 from his shoulders. In other words, by pulling downwardly upon the bar 144 with the arms while the yoke 136 is in the lowered position of FIG. 11, at least a portion of the weight of the yoke 136 is transferred to the arms from the shoulders to facilitate the return of the user to the FIG. 10 standing position. Thus, the grip means 140 permits the user's arms to more easily relieve weight of the yoke 136 which would otherwise be borne upon the user's shoulders and is advantageous in this respect.

It will be understood that numerous modifications and substitutions can be had to the aforedescribed embodiments without departing from the spirit of the invention. For example, the grip means of the aforedescribed embodiments have been shown and described as including grip bars which are either vertically or horizontally disposed, but grip means in accordance with the broader aspects of the invention may include grip bars which are arranged at an angle with respect to the vertical or horizontal. Further, although the grip means 140 of the FIG. 8 embodiment 130 has been shown and described as slidably movable relative to and along the length of guide rods 137 in coordination with the upward and downward movement of a shoulder-supported yoke, grip means may be constructed with rollers to permit the grips means to rollably move along the length of a rod or rail.

Accordingly, the aforedescribed embodiments are intended for the purpose of illustration and not as limitation.

I claim:

1. An exercise apparatus for use when performing a squat exercise wherein a user moves between a standing position and a squat position as he maintains his balance over his feet, the apparatus comprising:

resistance means supportable by the user for providing a resistance force in opposition to attempted movement of the user between the standing position and the squat position during a squat exercise wherein the resistance means includes a yoke assembly positionable about the neck of the user and to which the resistance force is applied so that as the user moves between a standing position and a squat position, the yoke assembly is moved between raised and lowered positions;

a base platform including a front;

guideway-providing means associated with the base platform for guiding and confining movement of the yoke assembly along a substantially vertical path as the user moves between the standing and the squat positions, the guideway-providing means includes at least two vertically-disposed rods between which the yoke assembly is positioned and wherein the two rods are spaced from one another to accommodate a forward and rearward shift of the yoke assembly relative to the base platform between forward and rearward limits of travel as the user moves between the standing and the squat positions during a squat exercise;

at least one post mounted upon the platform so as to extend generally upwardly therefrom;

grip means connected to the post capable of being gripped by the hands of the user throughout the performance of the squat exercise so that as the user moves between the standing position and the squat position, the grip means stabilize the user and thereby help the user to maintain his balance over his feet; and the yoke assembly includes a horizontally-disposed portion positionable across the neck of the user and carriage member portions secured to the guideways for slidable movement therealong, and the yoke assembly includes a ball joint assembly joining the horizontally-disposed portion to the carriage members to accommodate a pivotal shift of the horizontally-disposed portion relative to the carriage members during use of the apparatus.

2. The apparatus as defined in claim 1 wherein the grip means are movably attached to the post for upward and downward movement therealong, and the apparatus further comprises means cooperatively attached between the yoke assembly and the grip means so that when the yoke assembly is lowered by the user as the user moves from a standing position to a squat position, the grip means moves upwardly relative to the post from a lowered position to an elevated position and so that when the yoke assembly is raised by the user as the user moves from a squat position to a standing position, the grip means is permitted to move downwardly relative to the post from the elevated position to the lowered position,

3. The apparatus as defined in claim 2 wherein the cooperating means includes a cable connected between the grip means and the yoke assembly.

4. The apparatus as defined in claim 1 wherein the base platform is adapted to support a user during the performance of a squat exercise routine and has a front edge that is faced by the user when the user stands thereon, and the grip means are disposed adjacent the front edge of the platform so that when the user stands upon the platform for use of the apparatus, the grip means are disposed generally in front of the user.

* * * * *